US011033124B1

(12) United States Patent
Stark

(10) Patent No.: US 11,033,124 B1
(45) Date of Patent: Jun. 15, 2021

(54) MODULAR PICTURE FRAME SYSTEM

(71) Applicant: Patricia Stark, Olathe, KS (US)

(72) Inventor: Patricia Stark, Olathe, KS (US)

( * ) Notice: Subject to any disclaimer, the term of this patent is extended or adjusted under 35 U.S.C. 154(b) by 0 days.

(21) Appl. No.: 17/068,921

(22) Filed: Oct. 13, 2020

(51) Int. Cl.
*A47G 1/06* (2006.01)
*A47G 1/16* (2006.01)

(52) U.S. Cl.
CPC ..... *A47G 1/065* (2013.01); *A47G 1/1606* (2013.01); *A47G 1/1686* (2013.01)

(58) Field of Classification Search
CPC ..... A47G 1/065; G09F 15/0068; G09F 15/00; G09F 7/18; G09F 7/00; G09F 1/12
See application file for complete search history.

(56) References Cited

U.S. PATENT DOCUMENTS 3,722,122 A 3/1973 Sesto
4,115,938 A 9/1978 Belmuth
4,385,459 A 5/1983 McGrath
4,698,928 A * 10/1987 Soporowski ..... G09F 7/08 40/605
4,827,639 A 5/1989 Wang
D530,103 S 10/2006 Phillips
8,327,567 B2 12/2012 Swick
2004/0016164 A1* 1/2004 Gilchrist ..... A47G 1/065 40/729
2006/0185211 A1* 8/2006 Dalsey ..... A47G 1/065 40/729
2009/0049727 A1 2/2009 Vincent
2011/0308124 A1* 12/2011 Polin ..... G09F 15/0012 40/729

FOREIGN PATENT DOCUMENTS

CA 2613578 2/2009

* cited by examiner

*Primary Examiner* — Cassandra Davis
(74) *Attorney, Agent, or Firm* — Kyle A. Fletcher, Esq.

(57) ABSTRACT

The modular picture frame system comprises a starter strip and a plurality of frames. The starter strip may be mounted horizontally with on a wall. The plurality of frames may be hung from the starter strip in positions that are below the starter strip. Each individual frame selected from the plurality of frames may display a photograph. A new frame may be added to the plurality of frames by sliding a T-track of the new frame into the starter strip or into an extender channel of a previously hung frame. The plurality of frames may be organized into a horizontal arrangement, a vertical arrangement, a grid arrangement, an irregular arrangement, or combinations thereof.

19 Claims, 7 Drawing Sheets

MODULAR PICTURE FRAME SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of wall displays, more specifically, a modular picture frame system.

SUMMARY OF INVENTION

The modular picture frame system comprises a starter strip and a plurality of frames. The starter strip may be mounted horizontally with on a wall 90. The plurality of frames may be hung from the starter strip in positions that are below the starter strip. Each individual frame selected from the plurality of frames may display a photograph. A new frame may be added to the plurality of frames by sliding a T-track of the new frame into the starter strip or into an extender channel of a previously hung frame. The plurality of frames may be organized into a horizontal arrangement, a vertical arrangement, a grid arrangement, an irregular arrangement, or combinations thereof.

An object of the invention is to display a plurality of photographs in a plurality of frames.

Another object of the invention is to provide a starter strip that mounts to a wall and supports the upper most frames in a display area.

A further object of the invention is to provide a T-track at the top, rear of each frame for coupling that frame to the starter strip or to a previous hung frame.

Yet another object of the invention is to provide an extender channel at the bottom, rear of each frame for coupling that frame to a new frame hung below it.

These together with additional objects, features and advantages of the modular picture frame system will be readily apparent to those of ordinary skill in the art upon reading the following detailed description of the presently preferred, but nonetheless illustrative, embodiments when taken in conjunction with the accompanying drawings.

In this respect, before explaining the current embodiments of the modular picture frame system in detail, it is to be understood that the modular picture frame system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the modular picture frame system.

It is therefore important that the claims be regarded as including such equivalent construction insofar as they do not depart from the spirit and scope of the modular picture frame system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
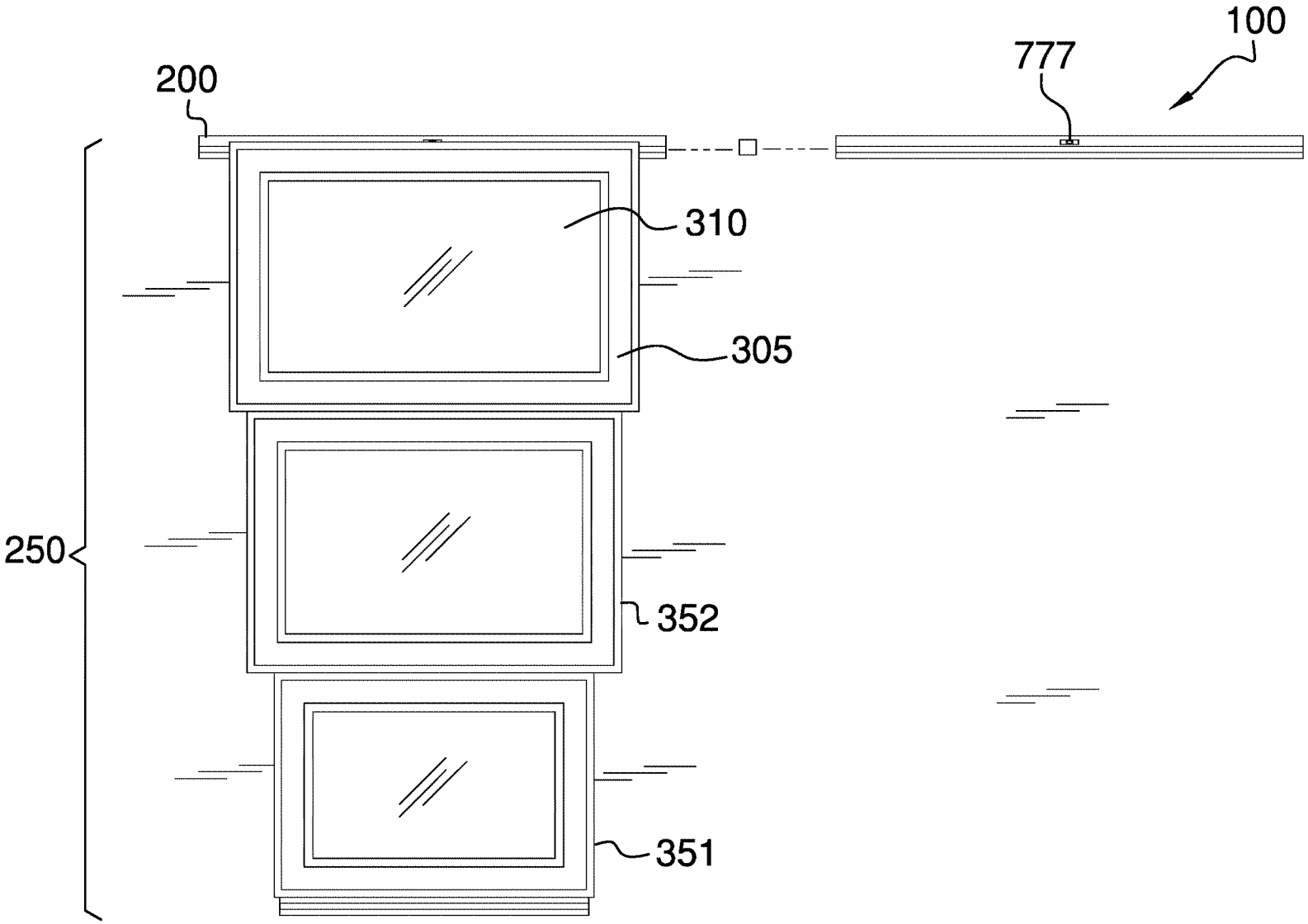
FIG. 1 is a front view of an embodiment of the disclosure illustrating three frames of unequal size hung from a starter strip.
Figure 2:
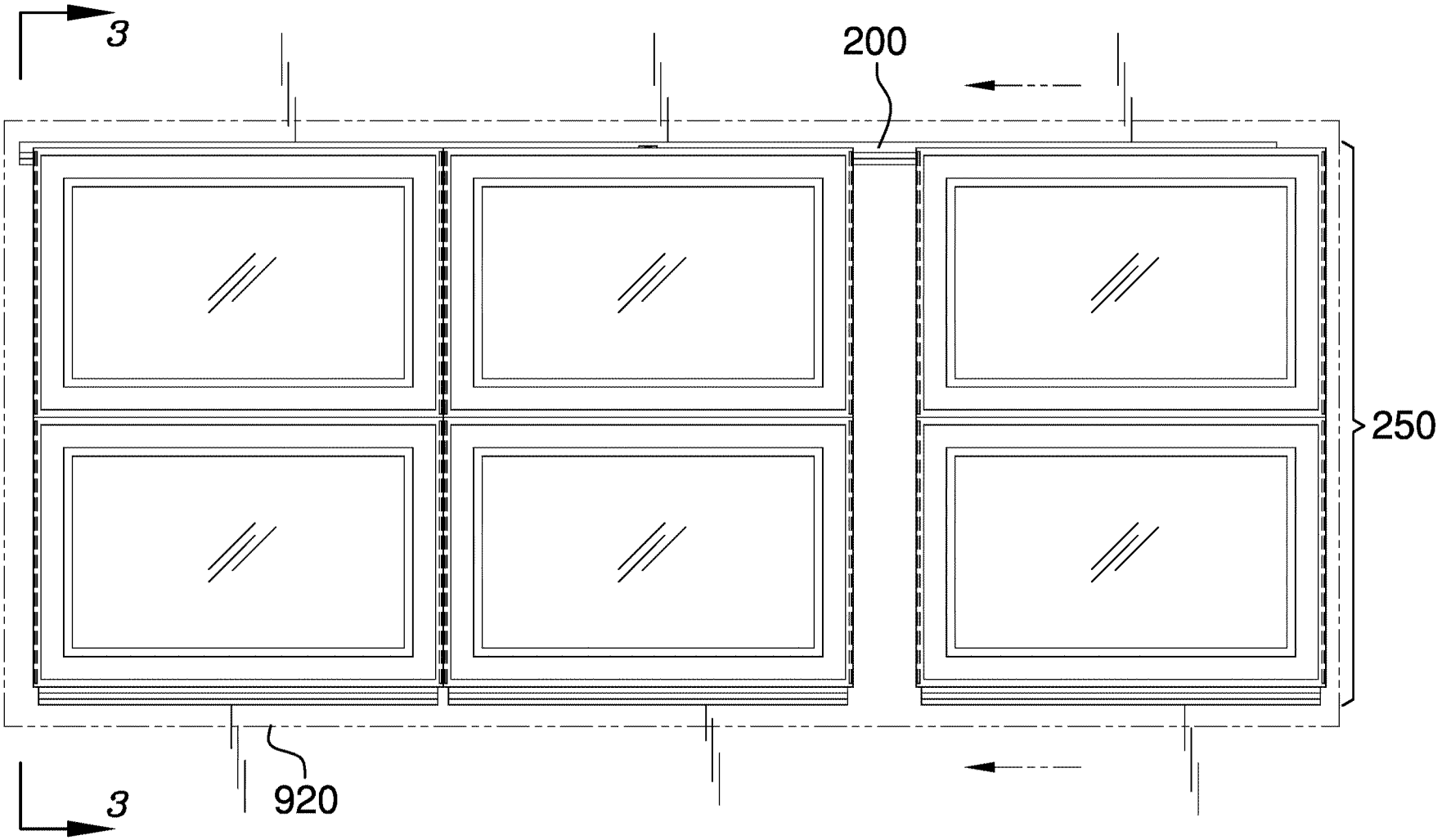
FIG. 2 is a front view of an embodiment of the disclosure illustrating two new frames being added to a group of four frames.
Figure 3:
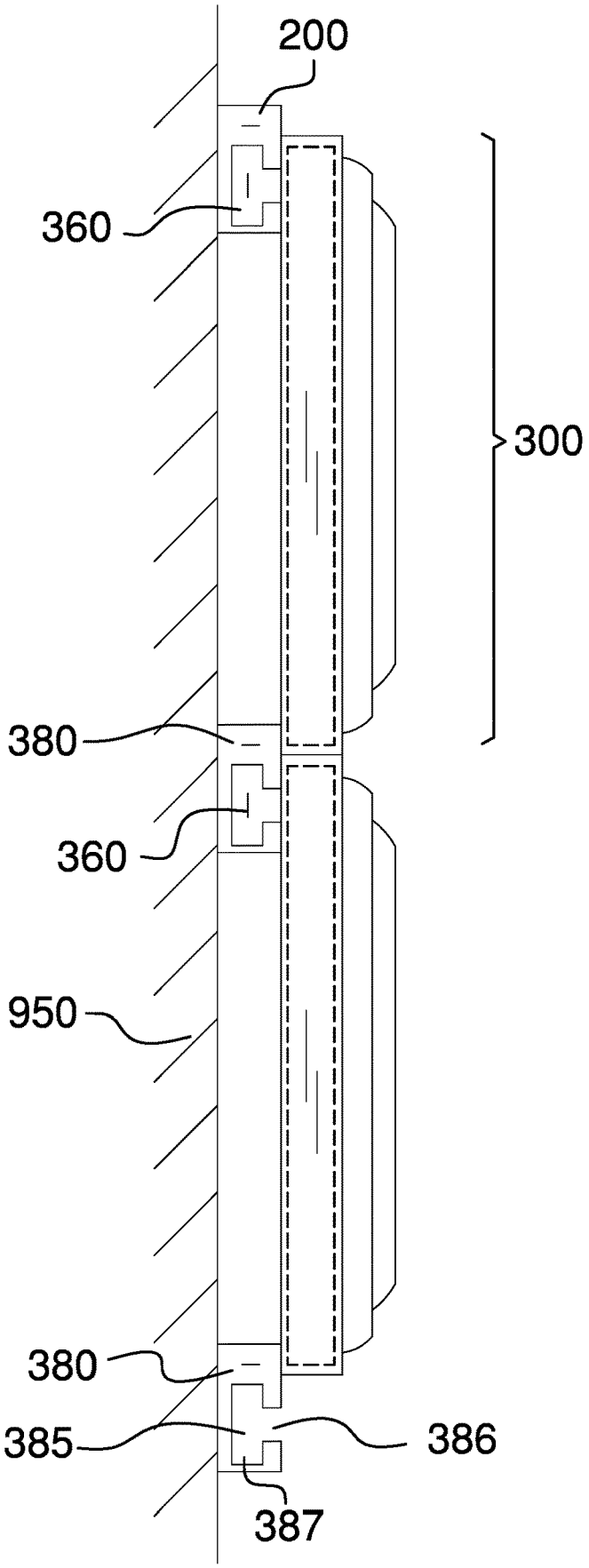
FIG. 3 is a cross-sectional view of an embodiment of the disclosure across 3-3 as shown in FIG. 2.
Figure 4:
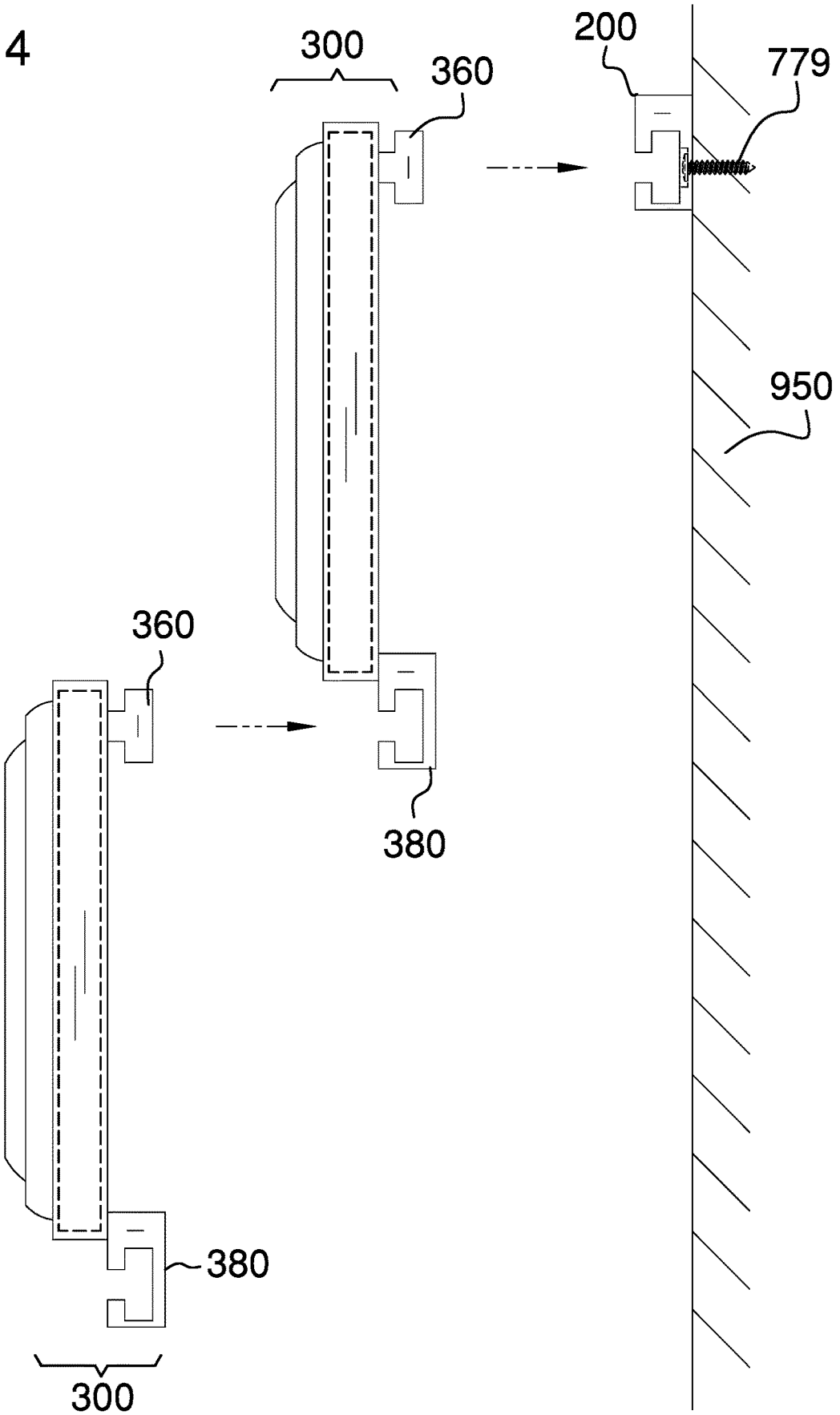
FIG. 4 is a side view of an embodiment of the disclosure.
Figure 5:
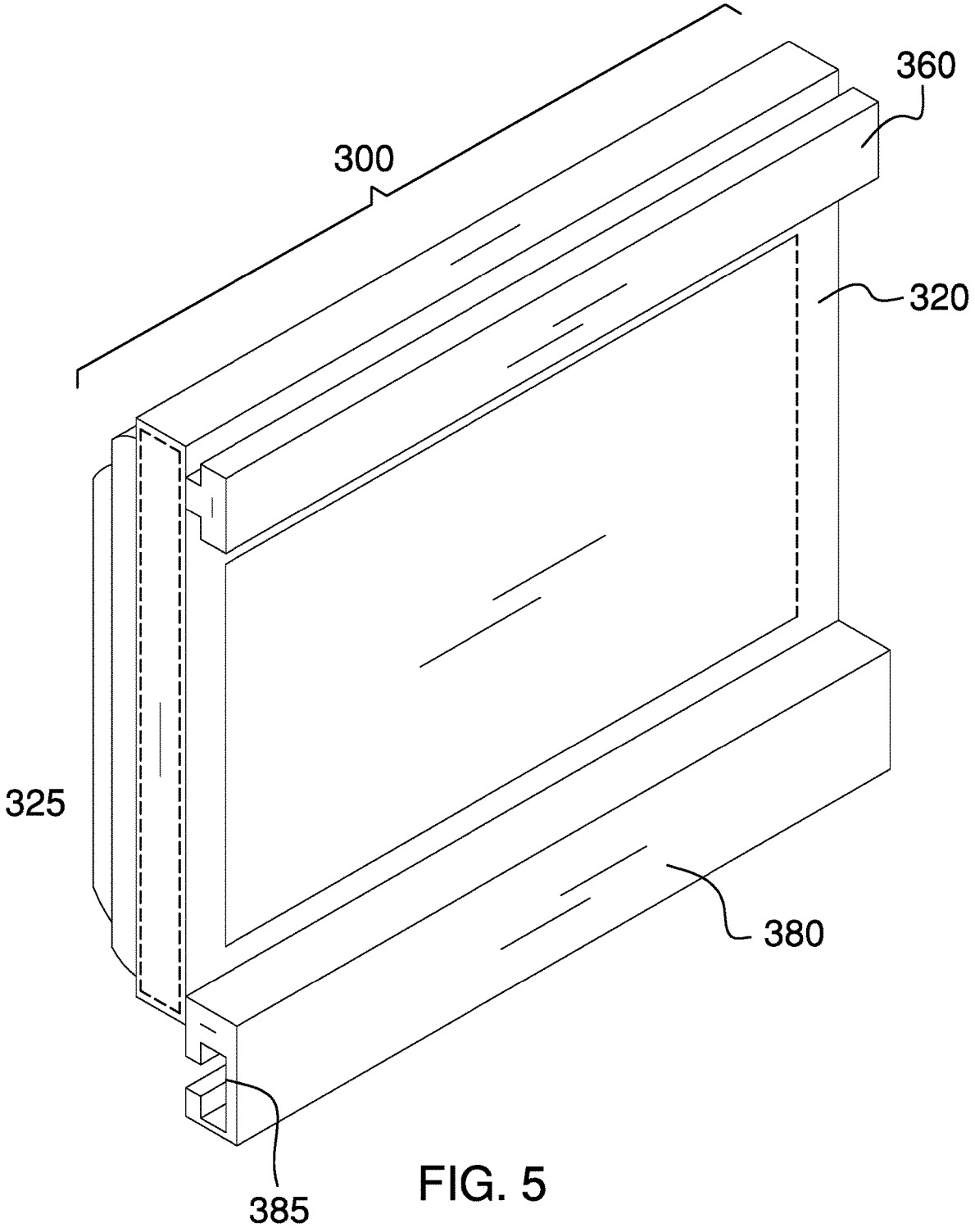
FIG. 5 is a perspective view of an embodiment of the disclosure illustrating the rear side of an individual frame.
Figure 6A:
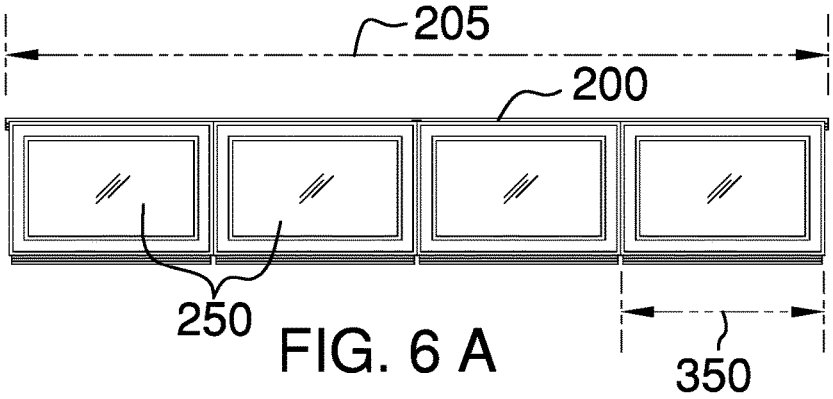
FIG. 6A is a front view of an embodiment of the disclosure illustrating a horizontal arrangement of four frames.
Figure 6B:
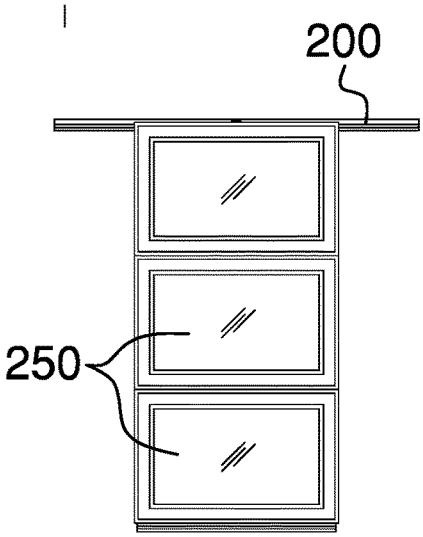
FIG. 6B is a front view of an embodiment of the disclosure illustrating a vertical arrangement of three frames.
Figure 6C:
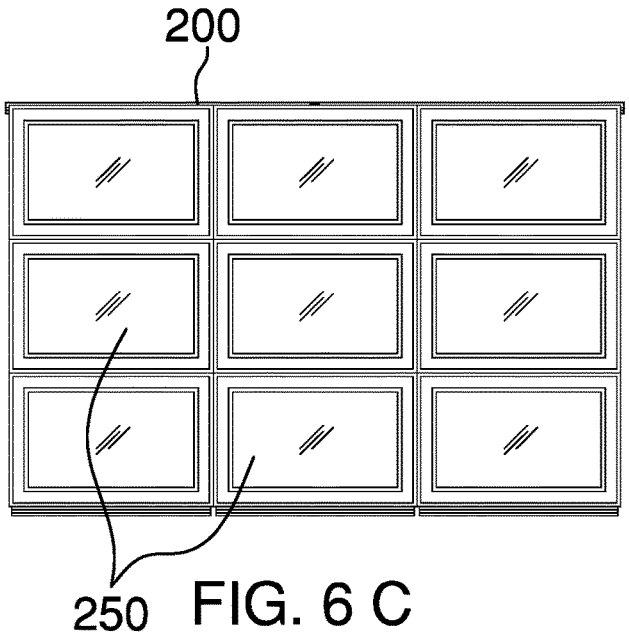
FIG. 6C is a front view of an embodiment of the disclosure illustrating a grid arrangement of nine frames.
Figure 6D:
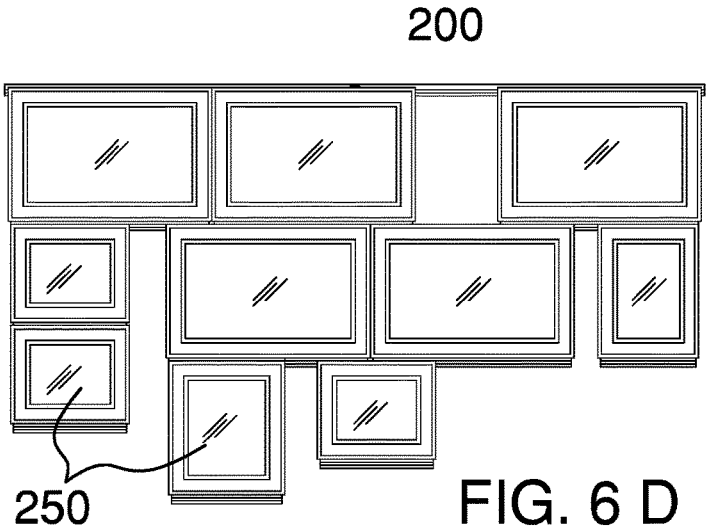
FIG. 6D is a front view of an embodiment of the disclosure illustrating an irregular arrangement of ten frames of various sizes and including some frames that are supported by more than one frame above them.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Detailed reference will now be made to a first potential embodiment of the disclosure, which is illustrated in FIGS. 1 through 7.

The modular picture frame system 100 (hereinafter invention) comprises a starter strip 200 and a plurality of frames 250. The starter strip 200 may be mounted horizontally with on a wall 950. The plurality of frames 250 may be hung from the starter strip 200 in positions that are below the starter strip 200. Each individual frame 300 selected from the plurality of frames 250 may display a photograph. A new frame 351 may be added to the plurality of frames 250 by sliding a T-track 360 of the new frame 351 into the starter strip 200 or into an extender channel 380 of a previously hung frame 352.

The starter strip 200 may be a length of extruded channel. The starter strip 200 may be mounted horizontally on the wall 950 at the top of a display area 920. The starter strip 200 may have a lateral cross-section that forms a T-shaped cavity 385. The T-shaped cavity 385 may be oriented on its side such that the front end of a horizontal portion 386 of the T-shaped cavity 385 opens to the front of the starter strip 200, the rear end of the horizontal portion 386 intersects with the center of a vertical portion 387, and the vertical portion 387 extends above and below the horizontal portion 386 within the starter strip 200.

One or more of the plurality of frames 250 may be coupled to the starter strip 200 by sliding the T-track 360 located on each of the plurality of frames 250 into the T-shaped cavity 385 of the starter strip 200. The number of frames that may be coupled to the starter strip 200 is determined by the width of the starter strip 200 and the width 350 of the individual frames 300. In some embodiments, the sum of the widths 350 of the individual frames 300 that are directly coupled to the starter strip 200 may not exceed the width of the starter strip 205.

The individual frame 300 selected from the plurality of frames 250 may protect the photograph that is displayed within the individual frame 300. The individual frame 300 may comprise a border 305, a pane 310, a backing 320, the T-track 360, and the extender channel 380. The border 305 may be a decorative edging around the photograph. As non-limiting examples, the border 305 may be made from resin, metal, plastic, word, or combinations thereof.

The pane 310 may be a transparent sheet covering the front of the photograph. As non-limiting examples, the pane 310 may be made of glass or clear acrylic plastic.

The backing 320 may be a sheet of material covering the rear of the individual frame 300 to retain the photograph within the individual frame 300. In some embodiments, the backing 320 may be removable or may comprise a hinged flap 325 to allow access for inserting or removing the photograph.

The T-track 360 may be an extruded armature that couples to the rear of the individual frame 300 along the top edge of the backing 320. The T-track 360 may removably couple to the starter strip 200 or to the extender channel 380 of another frame when the individual frame 300 is installed. The lateral cross-section of the T-track 360 may complement the lateral cross-section of the starter strip 200. The dimensions of the T-track 360 may be smaller than corresponding dimensions of the T-shaped cavity 385 in the starter strip 200 or the T-shaped cavity 385 in the extender channel 380 such that the T-track 360 may slide through the T-shaped cavity 385.

The extender channel 380 may be a length of extruded channel. The starter strip 200 may be mounted horizontally on the rear of the individual frame 300 at the bottom of the backing 320. The extender channel 380 may have a lateral cross-section that forms the T-shaped cavity 385. The extender channel 380 may hang below the individual frame 300 such that the T-shaped cavity 385 is accessible from the front by the T-track 360 of another frame installed below the individual frame 300.

The plurality of frames 250 may be organized into a horizontal arrangement, a vertical arrangement, or combinations thereof. The horizontal arrangement (see FIG. 6A) may comprise two or more of the plurality of frames 250 that are aligned along a horizontal axis. The vertical arrangement (see FIG. 6B) may comprise two or more of the plurality of frames 250 that are aligned along a vertical axis. A grid arrangement (see FIG. 6C) may comprise four or more of the plurality of frames 250 that are aligned along at least one horizontal axis and along at least one vertical axis. An irregular arrangement (see FIG. 6D) may comprise any number of the plurality of frames 250 that are not aligned. In some embodiments, one or more of the individual frames 300 in the irregular arrangement may be supported by the T-shaped cavities 385 of two or more other frames located above them.

In some embodiments, the individual frame 300 may be waterproof to protect the photograph from moisture and humidity.

In use, the starter strip 200 is mounted horizontally to the wall 950 at the top of the display area 920. The photographs are placed within the plurality of frames 250. One or more of the plurality of frames 250 are hung from the starter strip 200 by sliding the T-track 360 on each of the individual frames 300 into the starter strip 200 from one side of the starter strip 200 or the other. The plurality of frames 250 may butt against each other horizontally or gaps may be left between them. The gaps may be the same width between the plurality of frames 250 or the spacing may be irregular.

Additional frames may be hung from previously hung frames by sliding the T-track 360 on each of the additional frames into the extender channels 380 at the bottom of the previously hung frames. The additional frames may hang in a straight vertical line or may be staggered, including the inclusion of one or more frames that hang from two or more previously hung frames. The plurality of frames 250 may be a homogeneous size or the sizing of the plurality of frames 250 may vary.

Figure 7:
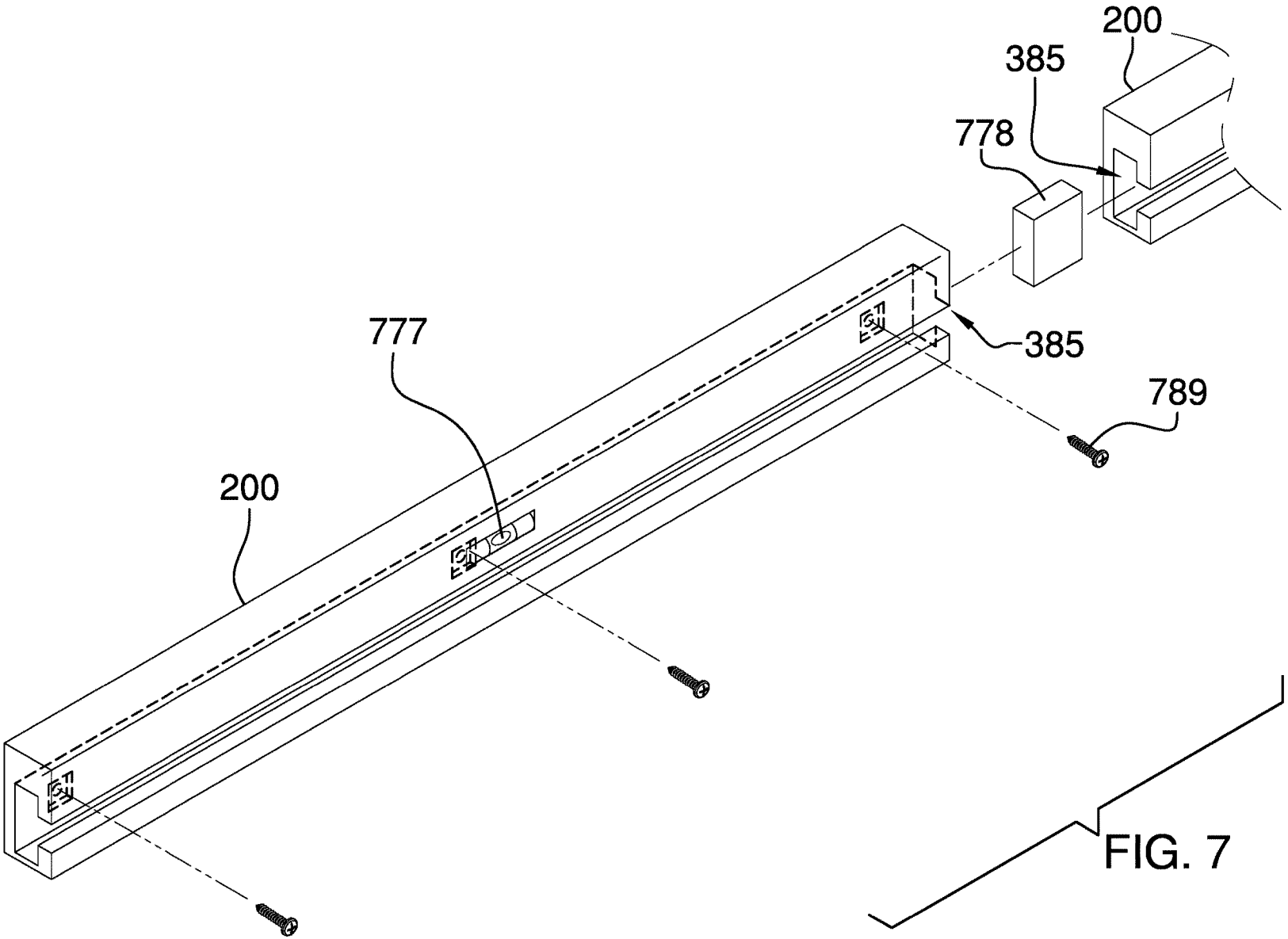
FIG. 7 is a perspective view of an embodiment of the disclosure.

Referring to FIG. 7, the starter strip 200 may include a bubble level 777 thereon. This helps to insure that the invention 100 is level when installed. Connector shims 778 may also be used to aid in alignment of adjacent starter strips 200. The connector shims 778 enable multiple starter strips 200 to be used and aligned with one another. The connector shims 778 are blocks that are able to slide in the T-shaped cavity 385 of the starter strip 200. Screws 779 are depicted on FIG. 7 as the means of securing the invention 100 against the wall 950.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, a "cavity" is an empty space or negative space that is formed within an object.

As used in this disclosure, a "channel" is a tubular passage through which an object or fluid is passed through.

As used in this disclosure, the word "correspond" indicates that a first object is in some manner linked to a second object in a one to one relationship or that one or more properties shared by two or more objects match, agree, or align within acceptable manufacturing tolerances.

As used herein, the words "couple", "couples", "coupled" or "coupling", refer to connecting, either directly or indirectly, and does not necessarily imply a mechanical connection.

As used in this disclosure, a "cross-section" is a surface or shape that would be exposed by making a straight cut through an object.

As used herein, "lateral cross-section" refers to a cross-section that is perpendicular to the longitudinal axis.

As used in this disclosure, a "flap" is a piece of material that is hinged or otherwise attached to a surface using one side such that the piece of material hangs in such a way as to cover a hole in a surface or to provide a barrier between objects.

As used herein, "front" indicates the side of an object that is closest to a forward direction of travel under normal use of the object or the side or part of an object that normally presents itself to view or that is normally used first. "Rear" or "back" refers to the side that is opposite the front.

As used in this disclosure, a "grid" is a network of intersecting parallel and perpendicular lines.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, the word "lateral" refers to the sides of an object or movement towards a side. Lateral directions are generally perpendicular to longitudinal directions. "Laterally" refers to movement in a lateral direction.

As used in this disclosure, a "track" is a device that is used to control the path of motion of an object in at least one dimension.

As used in this disclosure, "transparent" refers to a material that allows light to pass through the material without significant scattering such that an object can be clearly seen through the material.

As used in this disclosure, "vertical" refers to a direction that is parallel to the local force of gravity. Unless specifically noted in this disclosure, the vertical direction is always perpendicular to horizontal.

As used herein, the word "waterproof" refers to an object that is not harmed when being exposed to water, including total submersion for a period of time. When used as a verb, "waterproof" refers to taking steps to make an object waterproof. Non-limiting examples of such steps may include applying special coatings or using gaskets to seal seams and entry points of an enclosure.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A modular picture frame system comprising:

a starter strip and a plurality of frames;

wherein the starter strip is configured to be mounted horizontally with on a wall;

wherein the plurality of frames are hung from the starter strip in positions that are below the starter strip;

wherein each individual frame selected from the plurality of frames displays a photograph;

wherein a new frame is added to the plurality of frames by sliding a T-track of the new frame into the starter strip or into an extender channel of a previously hung frame;

wherein the starter strip is a length of extruded channel;

wherein the starter strip is mounted horizontally on the wall at a top of a display area;

wherein the starter strip has a lateral cross-section that forms a T-shaped cavity;

wherein the T-shaped cavity is oriented on its side such that a front end of a horizontal portion of the T-shaped cavity opens to a front of the starter strip, a rear end of the horizontal portion intersects with a center of a vertical portion, and the vertical portion extends above and below the horizontal portion within the starter strip;

wherein one or more of the plurality of frames are coupled to the starter strip by sliding the T-track located on each of the plurality of frames into the T-shaped cavity of the starter strip.

2. The modular picture frame system according to claim 1 wherein the sum of widths of the individual frames that are directly coupled to the starter strip do not exceed the width of the starter strip.

3. The modular picture frame system according to claim 1 wherein the individual frame selected from the plurality of frames protects the photograph that is displayed within the individual frame;

wherein the individual frame comprises a border, a pane, a backing, the T-track, and the extender channel;

wherein the border is a decorative edging around the photograph.

4. The modular picture frame system according to claim 3 wherein the border is made from resin, metal, plastic, word, or combinations thereof.

5. The modular picture frame system according to claim 3 wherein the pane is a transparent sheet covering a front of the photograph.

6. The modular picture frame system according to claim 5 wherein the pane is made of glass or clear acrylic plastic.

7. The modular picture frame system according to claim 5 wherein the backing is a sheet of material covering a rear of the individual frame to retain the photograph within the individual frame.

8. The modular picture frame system according to claim 7 wherein the backing is removable or comprises a hinged flap to allow access for inserting or removing the photograph.

9. The modular picture frame system according to claim 7 wherein the T-track is an extruded armature that couples to the rear of the individual frame along a top edge of the backing;

wherein the T-track removably couples to the starter strip or to the extender channel of another frame when the individual frame is installed;

wherein a lateral cross-section of the T-track complements the lateral cross-section of the starter strip;

wherein dimensions of the T-track is smaller than corresponding dimensions of the T-shaped cavity in the starter strip or the T-shaped cavity in the extender channel such that a T-track slides through the T-shaped cavity.

10. The modular picture frame system according to claim 9 wherein the extender channel is a length of extruded channel;

wherein the starter strip is mounted horizontally on the rear of the individual frame at a bottom of the backing;

wherein the extender channel has a lateral cross-section that forms the T-shaped cavity.

11. The modular picture frame system according to claim 10 wherein the extender channel hangs below the individual frame such that the T-shaped cavity is accessible from the front by the T-track of another frame installed below the individual frame.

12. The modular picture frame system according to claim 11 wherein the plurality of frames are organized into a horizontal arrangement, a vertical arrangement, a grid arrangement, an irregular arrangement, or combinations thereof.

13. The modular picture frame system according to claim 12 wherein the horizontal arrangement comprises two or more of the plurality of frames that are aligned along a horizontal axis.

14. The modular picture frame system according to claim 12 wherein the vertical arrangement comprises two or more of the plurality of frames that are aligned along a vertical axis.

15. The modular picture frame system according to claim 12 wherein the grid arrangement comprises four or more of the plurality of frames that are aligned along at least one horizontal axis and along at least one vertical axis.

16. The modular picture frame system according to claim 12 wherein the irregular arrangement comprises any number of the plurality of frames that are not aligned.

17. The modular picture frame system according to claim 16 wherein one or more of the individual frames in the irregular arrangement are supported by the T-shaped cavities of two or more other frames located above them.

18. The modular picture frame system according to claim 12 wherein the individual frame is waterproof to protect the photograph from moisture and humidity.

19. The modular picture frame system according to claim 17 wherein the starter strip includes a bubble level thereon; wherein the bubble level aids in a level installation of the starter strip against the wall.

* * * * *